United States Patent [19]

Personnat

[11] 4,241,773

[45] Dec. 30, 1980

[54] COMBINATION HAND-TOOL

[76] Inventor: Patrice Personnat, Chateau Perigord, Monte-Carlo, Monaco

[21] Appl. No.: 12,768

[22] Filed: Feb. 16, 1979

[30] Foreign Application Priority Data

Feb. 21, 1978 [FR] France ..... 78 05148

[51] Int. Cl.[3] ..... B25G 1/08

[52] U.S. Cl. ..... 145/63; 206/373; 206/379

[58] Field of Search ..... 145/63, 62; 206/372, 206/373, 379

[56] References Cited

U.S. PATENT DOCUMENTS

| | | | |
|---|---|---|---|
| 518,106 | 4/1894 | Johnson | 145/62 |
| 728,188 | 5/1903 | Barstad | 145/63 |
| 2,629,413 | 2/1953 | Stettler | 145/63 |
| 3,194,286 | 7/1965 | Wagner | 145/63 |

*Primary Examiner*—Othell M. Simpson

*Assistant Examiner*—J. T. Zatarga

*Attorney, Agent, or Firm*—Karl W. Flocks

[57] ABSTRACT

A combination hand-tool, namely a pocket tool comprising a set of screwdriver blades contained in compartments in a handle forming a magazine therefor, having a cover-forming plate rotatably mounted about the axis of said handle and provided with an aperture capable of registering with anyone of the compartments and having a means for restraining its rotation and a means for locking in translation any tool extracted from its compartment, each tool having a shank of the same shape as each compartment and a notch for cooperating with the edge of said aperture, the cross-section of said aperture being smaller than that of any tool-element shank, whereby a tool element is selected, partially extracted from its compartment and locked with respect to said handle, the loss of any tool element being prevented.

4 Claims, 5 Drawing Figures

COMBINATION HAND-TOOL

BACKGROUND OF THE INVENTION

The present invention generally relates to screwdriver kits, pocket tool-sets or sets of spanners and, more particularly, to a combination hand-tool the tools of which are contained in a magazine-forming handle. In use, the required tool is partially extracted from the handle and firmly restrained. After use, it is released and reinserted into the handle-magazine.

In the various known devices of this kind, the tools are constituted by independent elements which may be sequentialy restrained with respect to the handle by means of a usual locking member. Such devices do not warrant against the tools being lost or lack of locking of said tools.

Multiple-use kits are also known, the elements or tools of which may be released by rotation of a cover but such devices lack strength or they act as mere dispensers of tools.

Applicant has disclosed in his French Patent Application No. 77-18 780 filed June 16, 1977, a device constituted by a magazine-handle having longitudinal compartments containing screwdriver blades which may be partially extracted into working position, said handle being covered by a rotating cover provided with apertures each intended to lock a tool being utilized through the edge thereof which inserts into a first notch in said tool on the opposite side to its working end. However, in said device the blades permanently project out of the handle in the rest position, in which they are locked by a second notch disposed on the side of the working end.

The above-mentioned French Patent Application also provides for a device comprising blades which are covered in their rest position but which are intended, after they have been selected through a single aperture in the cover, to be introduced into an axial operative compartment in the handle.

All these prior devices, although they have the advantage of constituting pocket tool-sets, do not have the desired convenience for their utilization.

SUMMARY OF THE INVENTION

It is the object of this invention to provide a pocket tool-set the magazine-handle of which is sealed off in the inoperative position by a rotative cover-forming plate which allows the functions both of selection of a blade and of locking thereof in the operative position.

The subject device of this invention comprises a handle-magazine having an end-face at its lower end and a cover at its upper end and containing a plurality of different tool blades either in one or more compartments or in individual compartments. These tool blades are restrained when inoperative by a plate forming a cover to the handle-magazine and authorizing only a partial release of the desired tool in the operative position thereof and the shank of which is restrained in the handle, inside a locking compartment. This feature prevents the tool from being lost. The selected tool is only partly extracted and is then securely locked in a special compartment located in the upper portion forming the handle cover, which cover is formed by an upper plate secured by screws or a clip and used to lock the tool and to seal off or uncover the compartments. This plate can be associated to an intermediate second plate for improving the selection and sealing-off procedures as given in more detail hereafter.

The upper plate is formed with a single aperture for effecting search and extraction of the required tool but not complete release thereof since the cross-section of said aperture is less than that of the tool shank. When the aperture registers with the compartment containing the selected took, the tool is disengaged and locked in translation by any convenient means such as a screw, nut, pin, slide and the like but preferably through the edge of the aperture in said plate, the same being adapted to engage with a notch, slit, hole, cavity or groove in the tool shank. In order to safely lock the extracted tool in translation, the aperture is thrust upon by a hairpin or coil spring reacting against the intermediate plate, which plate is in turn locked in rotation with respect to the handle-magazine by a catch mechanism or other mechanical means. In order to facilitate registry of the aperture with a compartment, the upper and intermediate plates are provided with such synchronism means preferably of the engaging type, examples being spring-blade/notch, gearwheel/pawl, ball/cavity systems and the like.

The tools include a shank of noncircular section to facilitate their locking in compartments of similar type and also a latching notch, groove, hole or cavity. The cross-section of the shank is greater than that of the apertures.

BRIEF DESCRIPTION OF THE DRAWINGS

The description which follows with reference to the accompanying nonlimitative exemplary drawings will give a clear understanding of how the invention can be carried into practice.

In the drawings.

DESCRIPTION OF THE PREFERRED EMBODIMENTS

Figure 1:
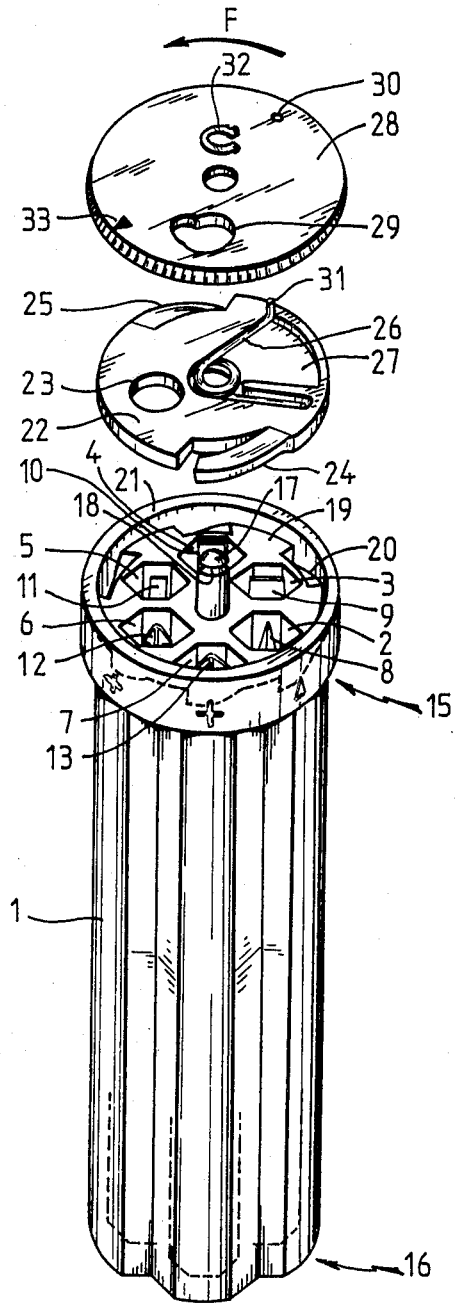
FIG. 1 is an exploded perspective illustration of one embodiment of the invention.
Figure 2:
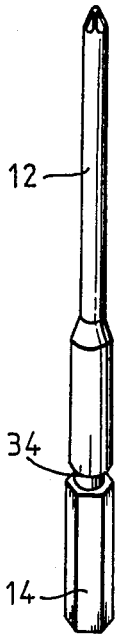
FIG. 2 shows a screwdriver tool usable with the embodiment of FIG. 1.
Figure 5:
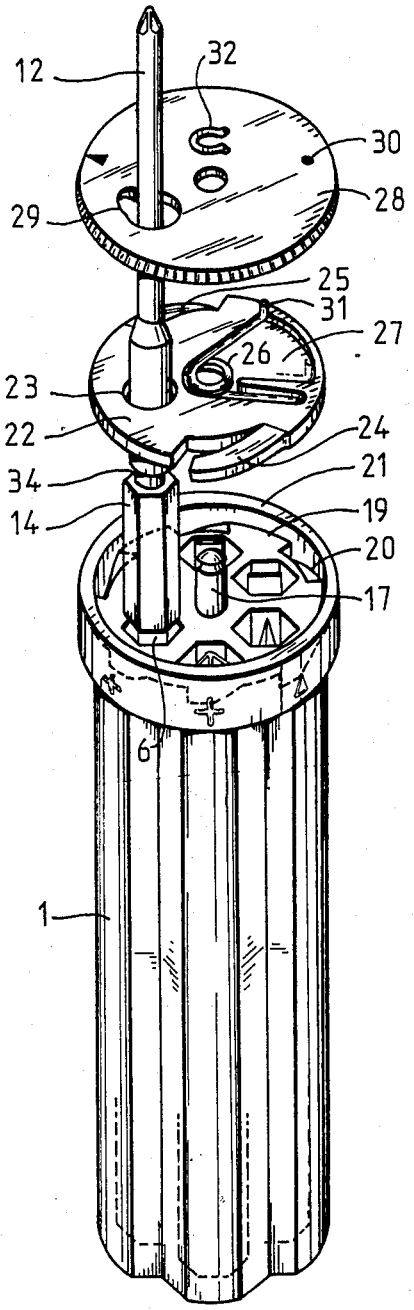

Referring to FIGS. 1, 2 and 5, a screwdriver kit according to this invention consists of three main parts:

1. A cylindrical splined handle-magazine 1 having six longitudinal compartments 2,3,4,5,6 and 7 of hexagonal section, containing six different tools such as screwdrivers and a center-punch 8, 9, 10, 11, 12 and 13, the shanks 14 of which have an identical cross-section in order to insure secure locking in rotation. The outer surface of each compartment is preferably engraved with an illustration of the tool-head or a symbol representing the corresponding tool. The upper part 15 of handle 1, remote from end-face 16, includes a central rod 17 formed with a circular groove 18 and a crown 19 formed with six engagement notches 20 protected by a flange 21;

2. A circular compartment-selection intermediate plate 22, coaxial with handle 1 and formed with a aperture 23, adapted to uncover the six compartments 2 through 7 in sucession. It is provided with two flexible engagement tongues 24 and 25 cooperating with the handle notches 20 and the compartments, and a hairpin spring 26 disposed in a special lodging 27;

3. A circular upper plate 28 with a knurled rim, coaxial with handle 1 and formed with a single aperture 29 superimposable upon aperture 23 and of cross-section less than that of the shanks 14 of tools 8–13. A hole 30 renders plate 28 fast with the spring 26 in plate 22 through a bent portion 31 of spring 26 engaging with said hole 30, the two plates being restrained by a circlip 32 engaging into groove 18.

During the selection phase, upper plate 28, which bears a tool-index mark 33, simultaneously drives plate 22 only in the direction F authorized by tongues 24 and 25 until its aperture 23 uncovers the required compartment. At this point, upper plate 28 alone is counter-rotated until its aperture 29 registers with aperture 23, thereby permitting emergence of the tool either by upturning the handle or by an inertia effect. The tool is then securely locked as a result of the edge of aperture 29 penetrating into groove 34 responsively to the pressure of spring 26. A mere counter-rotation of upper plate 28 releases the tool which returns to its compartment, which is then completely sealed off by the return motion of spring 26 the degree of travel of which is calculated accordingly.

Figure 3:
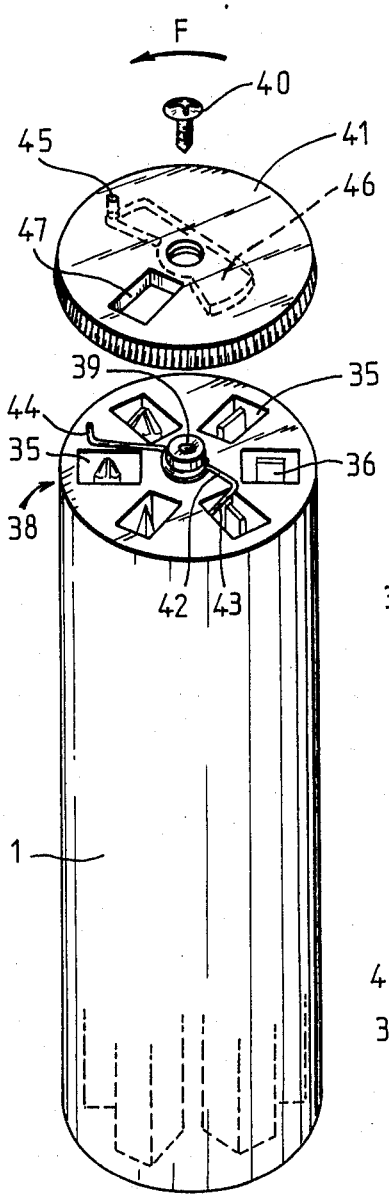
FIGS. 3 and 4 show an alternative form of embodiment of the invention and a corresponding screwdriver tool respectively and FIG. 5 is an exploded perspective illustration of the form of embodiment of FIG. 1 in the operative position.
Figure 4:
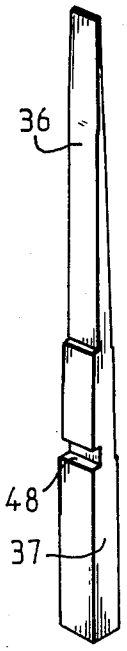

Reference to FIGS. 3 and 4 shows an alternative embodiment which includes a handle-magazine 1 and compartments 35 of, say, rectangular cross-section for accomodating different tools, one example of which is a screwdriver 36, the shank 37 of each tool having the same cross-section as the compartments 35. As in the embodiment described previously, the upper part 38 of the handle comprises a central rod 39 adapted on the one hand to receive a screw 40 for securing a single plate 41 and, on the other, to secure a spring 42. This spring has a first bent arm 43 capable of engaging in different compartments 35 and a second arm 44 which is bent in the opposite direction and engages into a hole 45 in plate 41. This plate is additionally formed with a recessed lodging 46 for said spring and with an aperture 47 of the same shape as the compartments 35 but of smaller cross-section. As in the embodiment described previously, each tool is formed with a groove 48.

Spring 42 is of the double-acting kind, that is, one which provides a positive engagement effect through its arm 43 capable of engaging in succession with the different compartments during selective rotation and a locking effect through its other arm 44 which thrusts against plate 41, causing aperture 47 whereby to lock a tool in its working position through engagement of the edge of said aperture in the groove 48. In the inoperative position, aperture 47 lies in between two compartments 35, thereby sealing off handle-magazine 1.

In addition to making the loss of a tool almost impossible, the combination tool according to this invention offers the advantage of presenting the selected tool eccentrically in relation to the handle axis, thereby augmenting its efficiency by reason of the increased torque.

Moreover, the combination tool of this invention permits the grouping into a single combination set of a plurality of screwdriver elements with flat, cruciform, angled or screw-holding heads, or of spanner-ends or other light tools, the number, length and quality of which may vary according to the case. It will be obvious to those skilled in the art that various changes may be made such as, for example, in the locking systems used, without departing from the scope of the invention and the invention is not to be considered limited to what is shown in the drawings and described in the specification.

What is claimed is:

1. A combination hand-tool comprising
a handle forming a magazine,
tool elements contained in said handle,
said handle being of generally cylindrical shape having lower and upper ends and including
longitudinal compartments of non-circular cross-section formed around the axis of said handle and opening toward said upper end,
first and second cover-forming plates forming an upper plate and an intermediate plate respectively and mounted for rotation about the axis of said handle at said upper end of said handle,
each of said plates having an aperture therein,
said aperture of said intermediate plate located to register with any one of said compartments,
said aperture of said upper plate having a portion capable of moving into a position coaxial with any one of said compartments and an adjoining portion of smaller diameter,
means to step the rotation of said cover-forming plates to permit said aperture of said intermediate plate to register with each of said compartments,
each of said tool elements including
a shank of substantially the same shape as each of said compartments and of greater cross-section in at least some part than said aperture of said upper plate,
a groove in each of said tool elements located to receive said adjoining portion of smaller diameter of said aperture of said upper plate,
means to hold each of said tool elements extracted from its compartment in the extracted position by holding said adjoining portion of smaller diameter in said groove of said tool element,
whereby said upper plate is held relative to said intermediate plate by said means to hold said extracted tool elements.

2. The combination hand-tool of claim 1, further characterized by
said means to step the rotation including
a raised crown portion at said upper end of said handle having notches therein,
pawl means on said intermediate plate cooperating with said notches when said plates are rotated to register said aperture of said intermediate plate with one of said compartments.

3. The combination hand-tool of claim 1, further characterized by
said means to hold said extracted tool elements including
a spring having two arms of which one of said arms engages said upper plate and the other of said arms engages said intermediate plate.

4. A combination hand-tool comprising
a handle forming a magazine,
tool elements contained in said handle,
said handle being of generally cylindrical shape having lower and upper ends and including
longitudinal compartments of non-circular cross-section formed around the axis of said handle and opening toward said upper end,
first and second cover-forming plates forming an upper plate and an intermediate plate respectively and mounted for rotation about the axis of said handle at said upper end of said handle, each of said plates having an aperture therein, said aperture of said intermediate plate located to register with any one of said compartments, said aperture of said upper plate having a portion capable of moving into a position coaxial with any one of said compartments and an adjoining portion of smaller diameter, a raised crown portion at said upper end of said handle having notches therein, pawl means on said intermediate plate cooperating with said notches when said plates are rotated to register said aperture of said intermediate plate with one of said compartments, a spring having two arms of which one of said arms engages said upper plate and the other of said arms engages said intermediate plate, each of said tool elements including a shank of substantially the same shape as each of said compartments and of greater cross-section in at least some part than said aperture of said upper plate, a groove in each of said tool elements located to receive said adjoining portion of smaller diameter of said aperture of said upper plate to hold such tool element with the action of said spring in a position extracted from its compartment.

* * * * *